US008336986B2

(12) United States Patent
Morishita

(10) Patent No.: US 8,336,986 B2
(45) Date of Patent: Dec. 25, 2012

(54) IMAGE FORMING APPARATUS, IMAGE FORMING METHOD AND COMPUTER READABLE STORAGE MEDIUM

(75) Inventor: Takashi Morishita, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 110 days.

(21) Appl. No.: 13/045,815

(22) Filed: Mar. 11, 2011

(65) Prior Publication Data

US 2011/0227979 A1 Sep. 22, 2011

(30) Foreign Application Priority Data

Mar. 16, 2010 (JP) ..... 2010-059989

(51) Int. Cl.
*B41J 19/18* (2006.01)
*B41J 29/393* (2006.01)

(52) U.S. Cl. ..... 347/19; 347/16

(58) Field of Classification Search ..... 347/19, 347/16

See application file for complete search history.

(56) References Cited

U.S. PATENT DOCUMENTS 6,945,721 B2 * 9/2005 Sato ..... 400/708
7,367,642 B2 * 5/2008 Ouchi et al. ..... 347/19
7,533,959 B2 * 5/2009 Ouchi et al. ..... 347/37
7,618,140 B2 * 11/2009 Kato ..... 347/19
7,681,974 B2 * 3/2010 Mizuno ..... 347/19
7,789,475 B2 9/2010 Morishita et al.
2009/0225126 A1 9/2009 Morishita

FOREIGN PATENT DOCUMENTS

JP 05345453 A * 12/1993
JP 2007098760 A * 4/2007
JP 2008-6793 1/2008

* cited by examiner

*Primary Examiner* — Julian Huffman
(74) *Attorney, Agent, or Firm* — Oblon, Spivak, McClelland, Maier & Neustadt, L.L.P.

(57) ABSTRACT

An image forming apparatus includes: a detection unit that detects the position of the leading edge of a medium in a sub-scanning direction, the detection unit being moved in a main-scanning direction at a speed identical to the speed of a carriage that moves in the main-scanning direction and discharges ink; a position acquisition unit that acquires the end position of the detection unit in the main-scanning direction when image formation on a first medium is completed; and a control unit that controls a leading edge detection position of the detection unit in the main-scanning direction according to a detection unit moving amount and a medium moving amount when the detection unit detects the leading edge of a second medium on which an image is formed after the image formation on the first medium.

18 Claims, 10 Drawing Sheets

IMAGE FORMING APPARATUS, IMAGE FORMING METHOD AND COMPUTER READABLE STORAGE MEDIUM

CROSS-REFERENCE TO RELATED APPLICATIONS

The present application claims priority to and incorporates by reference the entire contents of Japanese Patent Application No. 2010-059989 filed in Japan on Mar. 16, 2010.

BACKGROUND OF THE INVENTION

1. Field of the Invention

The present invention relates to an image forming apparatus, an image forming method and a computer readable storage medium.

2. Description of the Related Art

There is a known technique for reducing the time required for an image forming apparatus to complete an image forming job after the reception of job instruction. When an image is formed, the position of a carriage moving in a main-scanning direction must be accurately determined relative to a medium moving in a sub-scanning direction. Therefore, the position of the leading edge of the medium is first detected by a sensor provided in the carriage, and then the carriage is moved to a printing start position.

No image can be formed after detection of the leading edge until the carriage is moved to the printing start position. Therefore, to reduce the completion time of a job, Japanese Patent Application Laid-open No. 2008-6793, for example, discloses an inkjet recording device that does not perform leading edge detection if a determination is made that high feed accuracy can be achieved.

However, in the invention disclosed in Japanese Patent Application Laid-open No. 2008-6793, to determine the position of the leading edge of a medium accurately when images are formed continuously on a plurality of mediums, printing must be restarted after the position of the leading edge of each medium is detected. Therefore, the time from the start to the end of the job is prolonged.

SUMMARY OF THE INVENTION

It is an object of the present invention to at least partially solve the problems in the conventional technology.

According to an aspect of the present invention, there is provided an image forming apparatus including: a detection unit for scanning in a main-scanning direction at a speed equal to a speed of a carriage that moves in the main-scanning direction and discharges ink so as to detect a position of a leading end of a medium in a sub-scanning direction; a position acquisition unit for acquiring an end position of the detection unit in the main-scanning direction when image formation on a first medium is completed; and a control unit for controlling a leading end detection position of the detection unit in the main-scanning direction according to a moving amount of the detection unit and a moving amount of the medium when a leading end of a second medium is detected by the detection unit on which an image is formed succeeding to the first medium, the moving amount of the detection unit being an amount corresponding to time required for the movement of the detection unit from the end position to a predetermined position of the main-scanning direction, the moving amount of the medium being an amount corresponding to a moving time of the medium required for the leading edge of the second medium to move to the predetermined position in the sub-scanning direction.

According to another aspect of the present invention, there is provided an image forming method including steps of: scanning in a main-scanning direction at a speed equal to a speed of a carriage that moves in the main-scanning direction and discharges ink so as to detect a position of a leading end of a medium in a sub-scanning direction; acquiring an end position of a detection unit in the main-scanning direction when image formation on a first medium is completed; and controlling a leading end detection position of the detection unit in the main-scanning direction when a leading end of a second medium is detected by the detection unit on which an image is formed succeeding to the first medium, the controlling is performed according to a moving amount of the detection unit and a moving amount of the medium, the moving amount of the detection unit being an amount corresponding to time required for the movement of the detection unit from the end position to a predetermined position of the main-scanning direction, the moving amount of the medium being an amount corresponding to a moving time of the medium required for the leading edge of the second medium to move to the predetermined position in the sub-scanning direction.

According to still another aspect of the present invention, there is provided a computer readable storage medium embedded a program configured to execute by a computer steps of: scanning in a main-scanning direction at a speed equal to a speed of a carriage that moves in the main-scanning direction and discharges ink to so as to detect a position of a leading end of a medium in a sub-scanning direction; acquiring an end position of a detection unit in the main-scanning direction when image formation on a first medium is completed; and controlling a leading end detection position of the detection unit in the main-scanning direction when a leading end of a second medium is detected by the detection unit on which an image is formed following to the first medium, the controlling is performed according to a moving amount of the detection unit and a moving amount of the medium, the moving amount of the detection unit being an amount corresponding to time required for the movement of the detection unit from the end position to a predetermined position of the main-scanning direction, the moving amount of the medium being an amount corresponding to a moving time of the medium required for the leading edge of the second medium to move to the predetermined position in the sub-scanning direction.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

A preferred embodiment will next be described with reference to the drawings.

Figure 1:
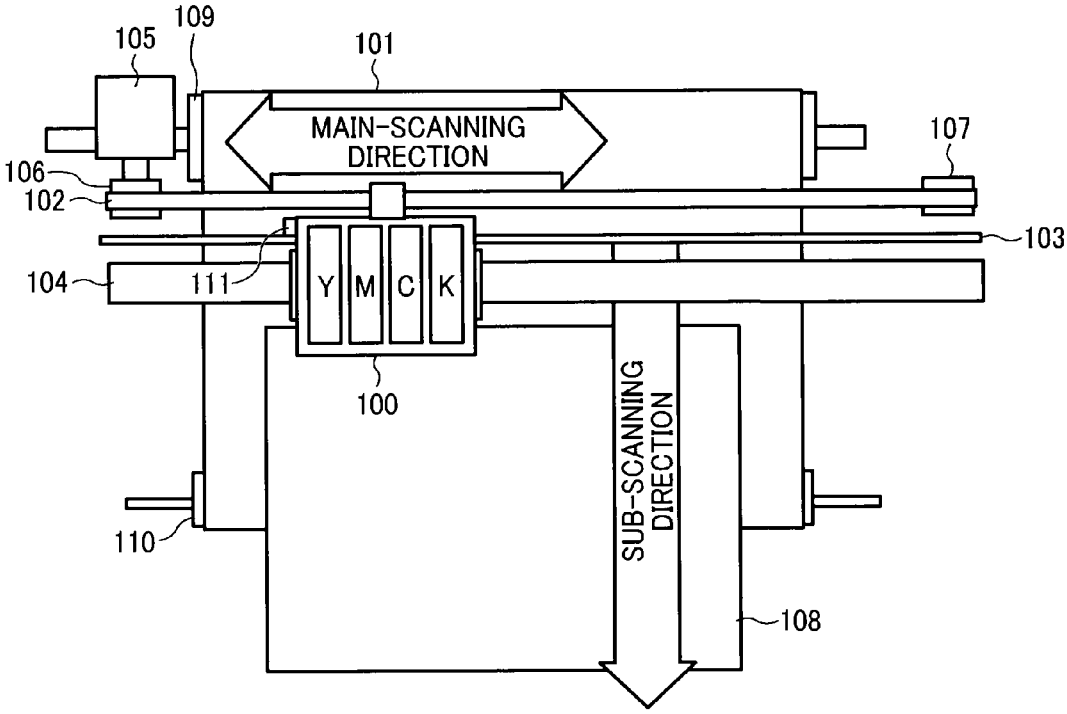
FIG. 1 is a top view of an inkjet image forming apparatus 1.
Figure 2:
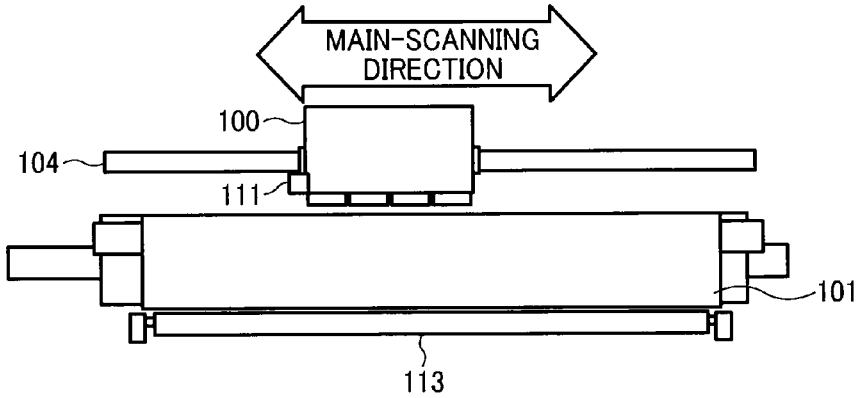
FIG. 2 is a front view of the inkjet image forming apparatus 1.

FIGS. 1 and 2 are schematic diagrams illustrating the mechanical unit of an inkjet image forming apparatus 1 according to the present embodiment. FIG. 1 is a top view of the inkjet image forming apparatus 1. FIG. 2 is a front view of the inkjet image forming apparatus 1.

The inkjet image forming apparatus 1 forms an image on a recording sheet 108 and then outputs the resultant recording sheet 108. The recording sheet 108 is fed from the upper side toward the lower side in FIG. 1. The direction orthogonal to this sub-scanning direction is a main-scanning direction. A carriage 100 performs a first main scan from the right to the left in FIG. 1. More specifically, when the upper side of an image to be formed on the recording sheet 108 is on the lower side in FIG. 1, the first main scan is performed from the left to right on the upper side of the image to be formed.

The inkjet image forming apparatus 1 includes the carriage 100, a sheet detection sensor 111, a carriage belt 101, a timing belt 102, an encoder scale 103, a guiding rod 104, a main-scanning motor 105, a driving pulley 106, a driven pulley 107, a carriage roller 109, and a tension roller 110.

The carriage 100 is retained by the guiding rod 104 transversally supported by left and right side plates (not shown) and is displaced for scanning in the main-scanning direction by the main-scanning motor 105 with the aid of the timing belt 102 stretched across the driving pulley 106 and the driven pulley 107.

The carriage 100 has four print heads that discharge droplets of four color ink, for example, yellow (Y), cyan (C), magenta (M), and black (K), respectively. Each of the print heads includes a plurality of ink discharge ports (nozzles) arranged in the sub-scanning direction orthogonal to the main-scanning direction and is disposed with the ink nozzles directed downward.

The print heads may not be independent for each color, and one print head may include a plurality of ink nozzles that discharge a plurality of recording liquid inks.

As a means to generate pressure for discharging liquid droplets from the print heads of the inkjet image forming apparatus, for example, a piezoelectric actuator, a thermal actuator, a shape-memory alloy actuator, or an electrostatic actuator is used.

The encoder scale 103 has slits and is disposed in the main-scanning direction. The carriage 100 is provided with a photo sensor (encoder sensor) for detecting the slits of the encoder scale 103 and can thereby serve as a linear encoder that detects the position of the carriage 100 in the main-scanning direction.

The sheet detection sensor 111 is disposed in the carriage 100 and detects the left and right edges of a sheet when the carriage 100 performs a scan. The width of a sheet can thereby be acquired. The sheet detection sensor 111 also detects the leading end of the sheet. The start position of the carriage 100 in which image formation starts by the carriage 100 can thereby de determined accurately when the image is formed.

The carriage belt 101 electrostatically attracts a recording sheet 108 and conveys the recording sheet 108 at a position facing the print heads of the carriage 100. The carriage belt 101 is an endless belt and is laid across the carriage roller 109 and the tension roller 110. Therefore, the carriage belt 101 moves around the sub-scanning direction and is charged by a roller charging device 113.

The carriage belt 101 has a single-layer structure or a multi-layer structure. When the carriage belt 101 has a single-layer structure, the entire layer is formed of an insulating material because the carriage belt 101 comes into contact with a recording sheet 108 and the roller charging device 113. When the carriage belt 101 has a multi-layer structure, a layer on the side adjoining a recording sheet 108 and the roller charging device 113 is formed as an insulating layer, and a layer that does not adjoin a recording sheet 108 and the roller charging device 113 may be formed as a conductive layer.

Figure 3:
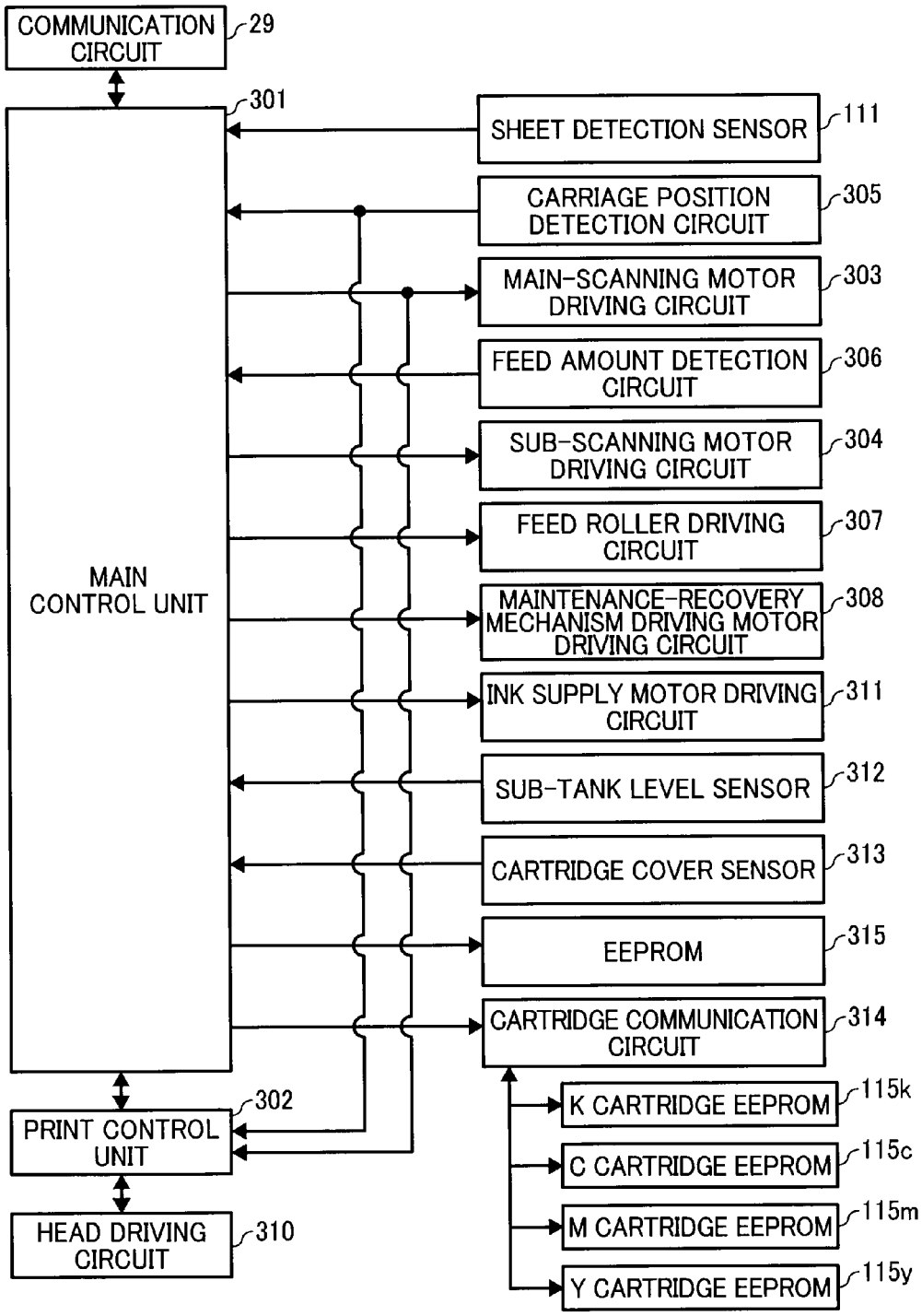
FIG. 3 is a diagram illustrating the configuration of the control unit of the inkjet image forming apparatus 1.

FIG. 3 is a diagram illustrating the configuration of the control unit of the inkjet image forming apparatus 1. The control unit in FIG. 3 includes a main control unit 301, a communication circuit 29, the sheet detection sensor 111, a carriage position detection circuit 305, a main-scanning motor driving circuit 303, a feed amount detection circuit 306, a sub-scanning motor driving circuit 304, a feed roller driving circuit 307, a maintenance-recovery mechanism driving motor driving circuit 308, an ink supply motor driving circuit 311, sub-tank level sensors 312, a cartridge cover sensor 313, an EEPROM 315, a cartridge communication circuit 314, a K cartridge EEPROM 115*k*, a C cartridge EEPROM 115*c*, an M cartridge EEPROM 115*m*, and a Y cartridge EEPROM 115*y*.

In the following description, the K cartridge EEPROM 115*k*, the C cartridge EEPROM 115*c*, the M cartridge EEPROM 115*m*, and the Y cartridge EEPROM 115*y* are collectively referred to as a "cartridge EEPROM 115."

The communication circuit 29 inputs information of a print job received from the outside to the main control unit 301. The carriage position detection circuit 305 detects the position of the carriage 100 in the main-scanning direction. More specifically, the carriage position detection circuit 305 detects the position of the carriage 100 from counting the number of slits of the encoder scale 103 in the main-direction read by a photo sensor of the carriage 100.

The main-scanning motor driving circuit 303 controls the rotation of the main-scanning motor 105 according to instructions from the main control unit 301 based on the position of the carriage 100 detected by the carriage position detection circuit 305 to displace the carriage 100.

The feed amount detection circuit 306 detects the amount of feed of a recording sheet 108 on the carriage belt 101, for example, using a photo sensor, by reading and counting the number of slits in a rotation direction of a rotary encoder sheet provided on the carriage roller 109. The sub-scanning motor driving circuit 304 controls the rotation of the carriage roller 109 according to instructions from the main control unit 301 based on the amount of feed of a recording sheet 108 to move the carriage belt 101 at a predetermined speed.

The feed roller driving circuit 307 rotates a feed roller (not shown) one turn to lead a recording sheet 108 from a paper feed tray to the conveying path of the carriage belt 101. The maintenance-recovery mechanism driving motor driving circuit 308 controls, for example, the upright movement of a wiper blade (not shown) to perform cleaning processing.

The ink supply motor driving circuit 311 drives ink supply motors (not shown). The ink supply motors supply inks from ink cartridges placed on the carriage 100 to head tanks from which the inks are supplied to the print heads.

The sub-tank level sensors 312 detect whether or not the head tanks which the carriage 100 has are full. The cartridge cover sensor 313 detects the open-close state of a cover of a cartridge installation section (not shown) of the carriage 100 on which the cartridges are placed.

The EEPROM 315 stores information to be processed by the main control unit 301. The information to be processed by the main control unit 301 is obtained by, for example, processing the information stored in the cartridge EEPROM 115. The information obtained is, for example, information of the remaining amounts of inks in the cartridges.

The cartridge communication circuit 314 mediates communication between the cartridge EEPROM 115 and the main control unit 301.

The main control unit 301 controls each unit to form an image on a recording sheet 108 according to input information of print processing from the communication circuit 29.

More specifically, the main control unit 301 acquires, according to the input position information from the carriage position detection circuit 305, the end position of the carriage 100 when the formation of an image on a recording sheet is completed. Then the main control unit 301 determines, from the end position of the carriage 100, a detection position used when the sheet detection sensor 111 detects the leading end of a recording sheet and also controls the timing of the start of the feed of the recording sheet.

The main control unit 301 detects the leading end of the recording sheet on the basis of the input position information from the sheet detection sensor 111. The main control unit 301 determines the start position of image formation by the carriage 100 according to the position of the leading end of the recording sheet and then controls the main-scanning motor driving circuit 303, the sub-scanning motor driving circuit 304, and other units.

More specifically, the main control unit 301 outputs motor driving instructions to the main-scanning motor driving circuit 303 and the sub-scanning motor driving circuit 304. The main control unit 301 also outputs print data to a print control unit 302.

The main control unit 301 outputs feed roller driving instructions to the feed roller driving circuit 307. The main control unit 301 also outputs instructions to drive a motor for cleaning processing to the maintenance-recovery mechanism driving motor driving circuit 308.

The main control unit 301 outputs instructions to drive the ink supply motors (not shown) to the ink supply motor driving circuit 311. The main control unit 301 outputs instructions to stop the ink supply motors according to the information detected by the sub-tank level sensors 312.

The main control unit 301 acquires the information stored in the cartridge EEPROM 115 through the cartridge communication circuit 314 to obtain the remaining amount of inks and other information and stores the obtained information in the EEPROM 315.

The print control unit 302 outputs, according to the print data inputted from the main control unit 301, instructions to drive the print heads to a head driving circuit 310. These instructions include instructions for the pressure to discharge ink droplets. These instructions further include the information of the position of the carriage 100 that is obtained from the output from the carriage position detection circuit 305 and the output from the feed amount detection circuit 306.

The head driving circuit 310 drives the print heads of the carriage 100 to discharge ink droplets toward a recording sheet 108. When the print heads are, for example, of the piezoelectric type header, the head driving circuit 310 drives a piezoelectric element provided in each print head as a pressure generator to discharge ink droplets from the nozzles.

FIGS. 4 to 7 are diagrams illustrating the positional relations between the carriage 100 and recording sheets 108 when the leading end of a succeeding sheet is detected after the final printing on a preceding sheet is completed. In FIGS. 4 to 7, only the carriage 100, the carriage belt 101, the sheet detection sensor 111, the carriage roller 109, the tension roller 110, and the recording sheet 108 are shown, and the rest of the units described in FIG. 1 are omitted.

Figure 4:
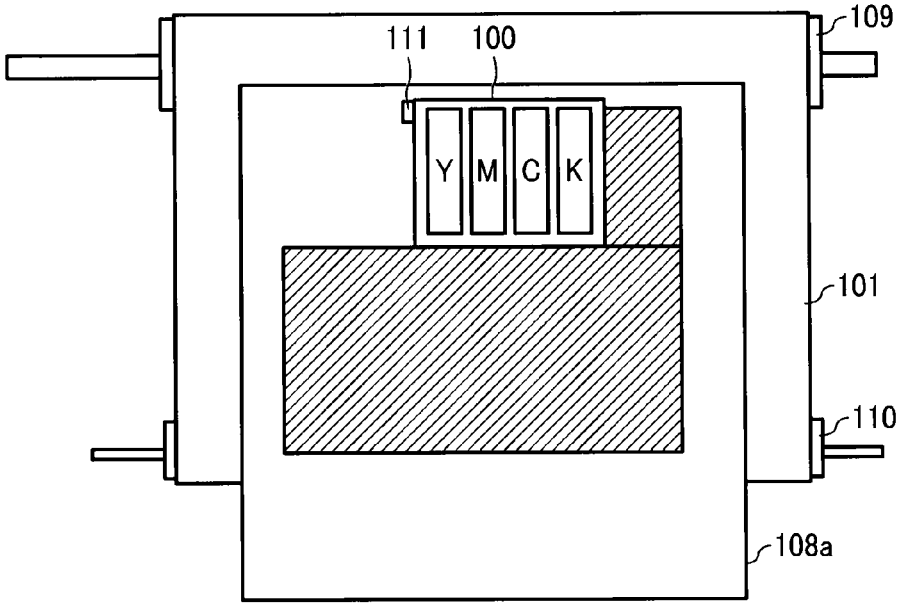
FIG. 4 is a diagram illustrating the positional relation (1) between a carriage 100 and recording sheets 108 when the leading edge of a succeeding sheet is detected.

FIG. 4 is a diagram illustrating the positional relation between the carriage 100 and a preceding recording sheet 108*a* when the final printing on the preceding recording sheet 108*a* completes. In FIG. 4, the carriage 100 is located within the width of the recording sheet 108*a* in the main-scanning direction.

Figure 5:
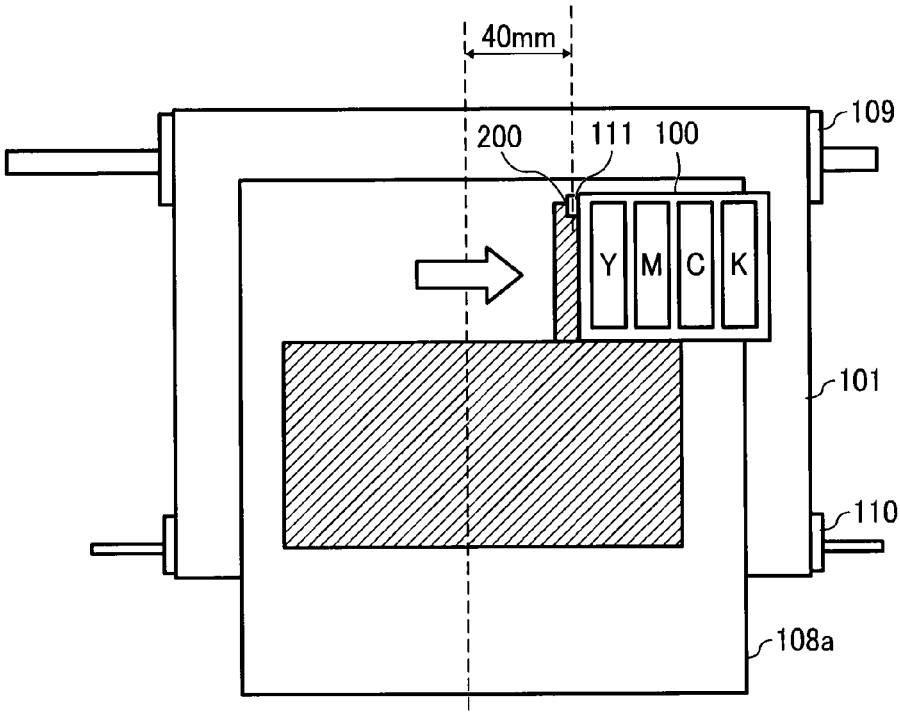
FIG. 5 is a diagram illustrating the positional relation (2) between the carriage 100 and the recording sheets 108 when the leading edge of the succeeding sheet is detected.

FIG. 5 is a diagram illustrating an example in which the carriage 100 is moved to a position for detecting the leading end of a succeeding recording sheet 108*b* (hereinafter referred to as a "detection position 200"). The detection position 200 is a position of a predetermined distance apart from the center of the recording sheet to the right in FIG. 5.

In this example, the predetermined distance is 40 mm. This value is smaller value than one half of a minimum width of the recording sheet on which the inkjet image forming apparatus 1 forms an image. The start position of printing on the recording sheet 108*b* is at the right side in FIG. 5. It is preferable that the detection position 200 be a position in the minimum width of the recording sheet and so close to the right side as possible in the FIG. 5.

In FIG. 5, the minimum width of the recording sheet is 100 mm, and the predetermined distance is 40 mm. Therefore, the detection position 200 can be a position within the range of the minimum width of the recording sheet in the main-scanning direction.

Figure 6:
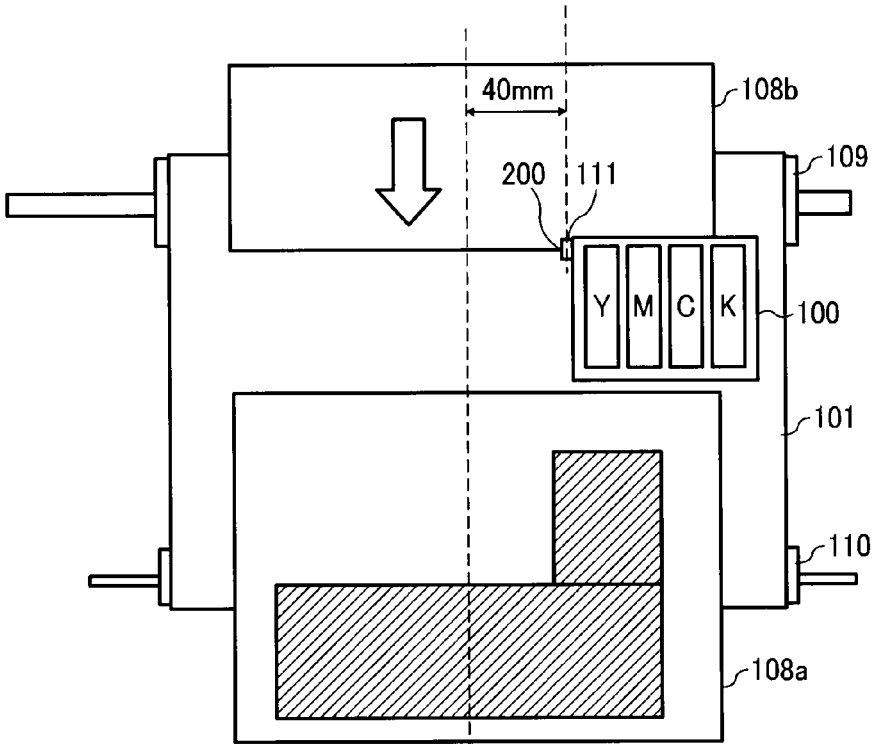
FIG. 6 is a diagram illustrating the positional relation (3) between the carriage 100 and the recording sheets 108 when the leading edge of the succeeding sheet is detected.

FIG. 6 is a diagram illustrating an example in which the recording sheet 108*a* is fed out and the recording sheet 108*b* is conveyed to the detection position 200. According to the positional relation in FIG. 6, the sheet detection sensor 111 can detect the leading end of the recording sheet 108*b*.

Figure 7:
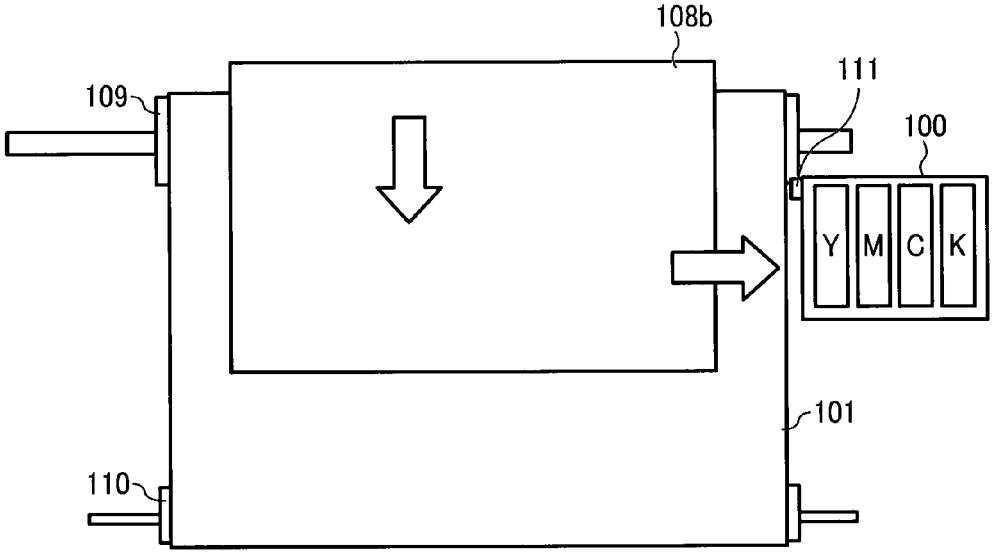
FIG. 7 is a diagram illustrating the positional relation (4) between the carriage 100 and the recording sheets 108 when the leading edge of the succeeding sheet is detected.

FIG. 7 is a diagram illustrating the positional relation when the carriage 100 is moved to a position for performing a first main scan after the positional relation in FIG. 6. In FIG. 7, the recording sheet 108*b* is conveyed in the sub-scanning direction to a position at which printing of an image starts.

In FIGS. 4 to 7, the movement of the carriage 100 and the conveyance of the first and second recording sheet 108*b* are performed in the following order.

(1) The carriage 100 starts moving toward the detection position 200.

(2) The conveyance of the recording sheet 108*b* is started ((2) may be performed simultaneously with (1) or before (1)).

(3) The carriage 100 stops at a position at which the sheet detection sensor 111 is located at the detection position 200.

(4) The recording sheet 108*b* passes below the carriage 100. During the passage, the sheet detection sensor 111 detects the leading end of the recording sheet 108*b*.

(5) The recording sheet 108*b* stops at a start position of image formation.

(6) The relative position of the carriage 100 relative to the recording sheet 108*b* when the image formation is started is determined.

(7) The carriage 100 moves to the position determined in (6).

In the operation in (1) to (7), after completion of the image formation on the recording sheet 108*a*, the carriage 100 moves to the detection position 200 to detect the leading end of the recording sheet 108*b* and then moves to the start position of image formation. Therefore, the carriage 100 is moved twice and stopped twice. More specifically, the carriage 100 is accelerated twice when moved and decelerated twice when stopped. Therefore, the speed-up of the job can be achieved by reducing the number of times of movement to one under predetermined conditions. More specifically, the position for detecting the leading end of the recording sheet 108*b* is not limited to the detection position 200 but is set within a predetermined range.

This predetermined range is, for example, the range within 40 mm from the center of the leading end of the recording sheet 108*b* in the left and right directions in FIGS. 4 to 7. This range is equal to or less than the minimum width on the recording sheet in the main-scanning direction within which the image forming apparatus can form an image. In this range, the leading end of the recording sheet can be always detected. This range is referred to as a "leading end detection range."

Figure 8:
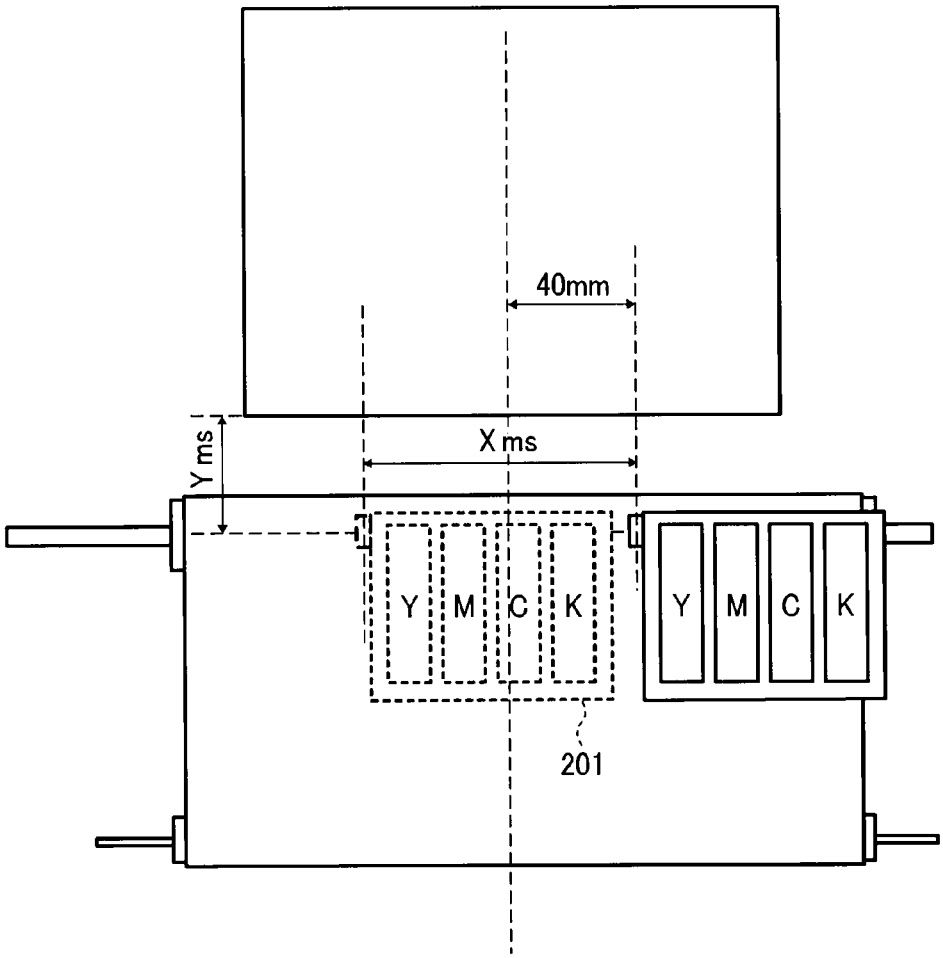
FIG. 8 is a diagram illustrating the relation between the time X required for the carriage 100 to move to a detection position 200 and the time Y required for the leading edge of a recording sheet 108*b* to reach the detection position 200.

FIG. 8 is a diagram illustrating the relation between the time X required for the carriage 100 to move to the detection position 200 after completion of the image formation on the preceding recording sheet 108*a* and the time Y until the leading end of the recording sheet 108*b* reaches the detection position 200.

In FIG. 8, the carriage 100 is located at a position 201 when the image formation on the recording sheet 108*a* is completed. If X>Y, when the movement of the carriage 100 and the movement of the recording sheet 108*b* are started simultaneously, the leading end of the recording sheet 108*b* reaches the detection position 200 before the sheet detection sensor 111 reaches the detection position 200. Therefore, when X>Y, the conveyance of the recording sheet 108*b* is started when a period of at least (X−Y) has elapsed after the start of the movement of the carriage 100. In this manner, after the sheet detection sensor 111 reaches the detection position 200, the leading end of the recording sheet 108*b* passes below the sheet detection sensor 111.

However, if the conveyance of the recording sheet 108*b* is started when a period of at least (X−Y) has elapsed, the time required for the job increases. Therefore, if the sheet detection sensor 111 is located within a predetermined distance from the center of the width of the recording sheet 108*b* in the main-scanning direction, the carriage 100 is not moved, and the leading end of the recording sheet 108*b* is detected irrespective of the detection position 200. In this case, the carriage 100 does not start moving, does not move toward the detection position 200 and does not stop at the detection position 200 (the operation in (1) and (3) described above), the time required for the job can be reduced.

Figure 9:
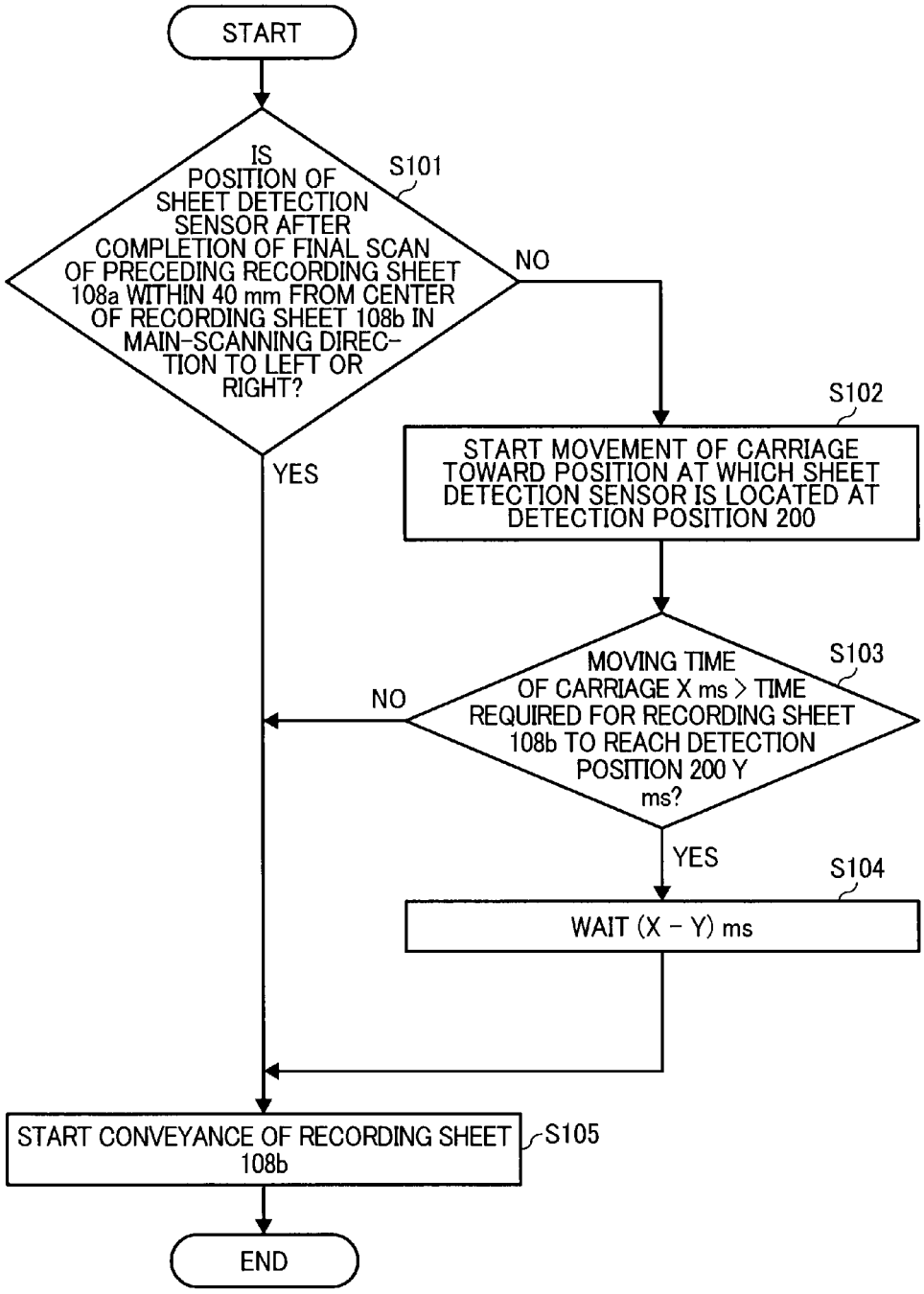
FIG. 9 is a flowchart showing processing (1) for controlling a detection position.

FIG. 9 is a flowchart showing the processing for controlling a detection position on the basis of the position of the carriage 100 after completion of the image formation on a preceding recording sheet 108*a*. The "completion of the image formation" refers to as "completion of the final scan" by the carriage 100.

In step S101 in FIG. 9, the main control unit 301 determines whether or not the position of the sheet detection sensor 111 after completion of the final scan of the preceding recording sheet 108*a* is within 40 mm from the center of the recording sheet in the main-scanning direction to the left or right. This determination is made according to the input from the carriage position detection circuit 305. If the position is within 40 mm, the process proceeds to step S105. If the position is not within 40 mm, the process proceeds to step S102.

In step S102 subsequent to step S101, the main control unit 301 outputs instructions to the main-scanning motor driving circuit 303 to start moving the carriage 100 toward a position for the sheet detection sensor 111 to be located at the detection position 200.

Then the process proceeds from step S102 to step S103, and the main control unit 301 compares the time X required for the movement of the carriage 100 with the time Y required for a succeeding recording sheet 108*b* to reach the detection position 200. The process proceeds to step S104 if X ms>Y ms. If not, the process proceeds to step S105.

In step S104 subsequent to step S103, the main control unit 301 waits for (X−Y) ms. In step S105 subsequent to step S101, S103, or S104, the main control unit 301 outputs instructions to the sub-scanning motor driving circuit 304 to start the conveyance of the recording sheet 108*b*.

In the processing in FIG. 9, even when X>Y, the conveyance of the recording sheet 108*b* is started with no wait time when the sheet detection sensor 111 is located within the leading end detection range, so that the chance of reducing the completion time of a job can be increased. Since the carriage 100 moving toward the detection position 200 does not stop at the detection position 200, noise and power consumption due to the movement can be suppressed.

Figure 10:
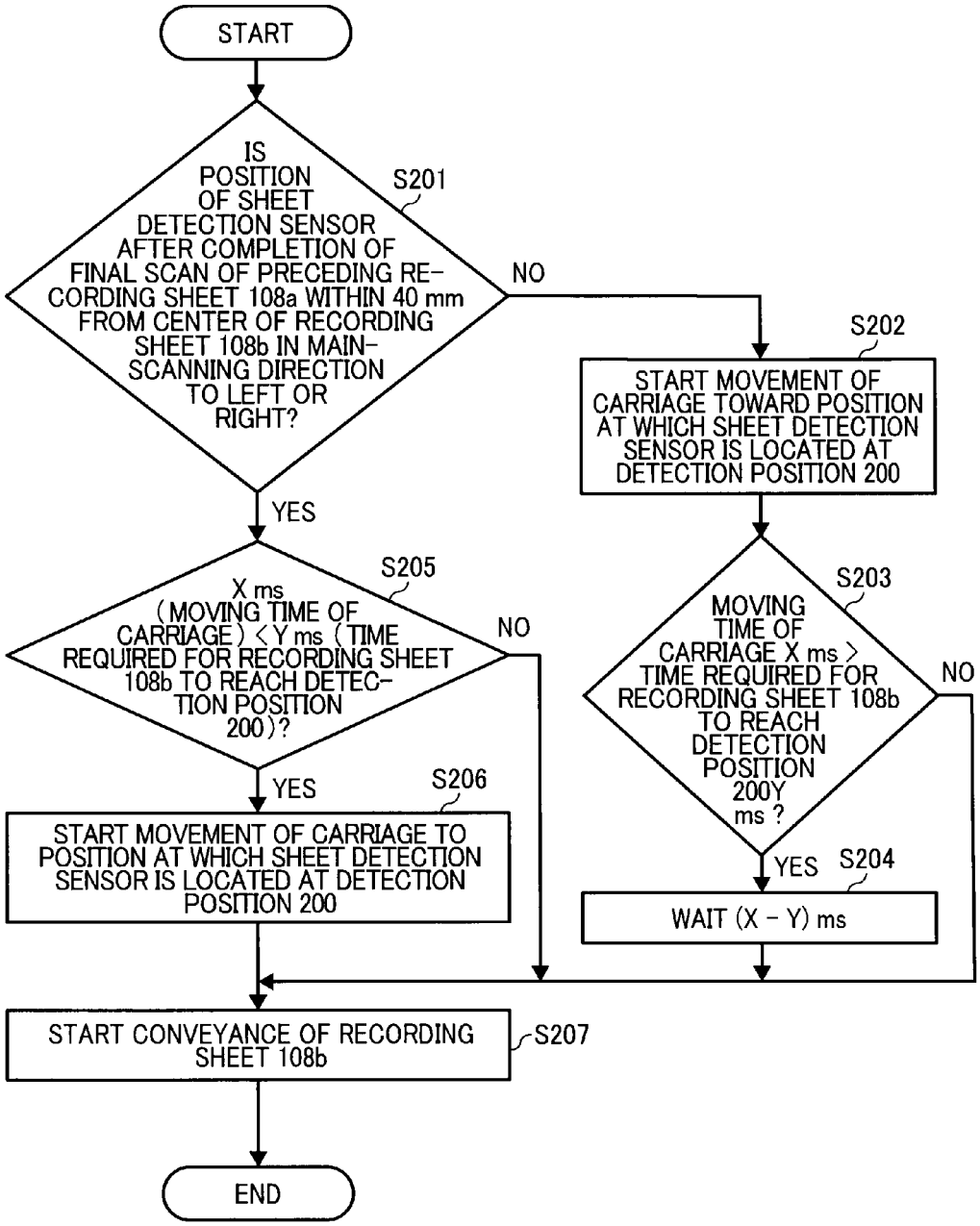
FIG. 10 is a flowchart showing processing (2) for controlling the detection position.

FIG. 10 is a flowchart showing the processing for controlling a detection position on the basis of the position of the carriage 100 after completion of image formation on a preceding recording sheet 108*a*. In the processing shown in this flowchart, the position for detecting the leading end of a succeeding recording sheet 108*b* is brought as close to the start position of image formation as possible.

In FIG. 10, the processing in steps S201 to S204 is substantially the same as the processing in steps S101 to S104 in FIG. 9.

In step S201 in FIG. 10, the main control unit 301 determines whether or not the position of the sheet detection sensor 111 after completion of the final scan of the preceding recording sheet 108*a* is within 40 mm from the center of the recording sheet in the main-scanning direction to the left or right. This determination is made according to the input from the carriage position detection circuit 305. If the position is within 40 mm, the process proceeds to step S205. If the position is not within 40 mm, the process proceeds to step S202.

In step S202 subsequent to step S201, the main control unit 301 outputs instructions to the main-scanning motor driving circuit 303 to start moving the carriage 100 toward a position for the sheet detection sensor 111 to be located at the detection position 200.

Then the process proceeds from step S202 to step S203, and the main control unit 301 compares the time X required for the movement of the carriage 100 with the time Y required for the recording sheet 108*b* to reach the detection position 200. The process proceeds to step S204 if X ms>Y ms. If not, the process proceeds to step S207.

In step S204 subsequent to step S203, the main control unit 301 waits (X−Y) ms.

In step S205 subsequent to step S201, the main control unit 301 compares the time X required for the movement of the carriage 100 with the time Y required for the recording sheet 108*b* to reach the detection position 200. The process proceeds to step S206 if X ms<Y ms. If not, the process proceeds to step S207.

In step S206 subsequently to step S205, the main control unit 301 outputs instructions to the main-scanning motor driving circuit 303 to start moving the carriage 100 toward a position for the sheet detection sensor 111 to be located at the detection position 200.

In step S207 subsequent to step S201, S204, or S206, the main control unit 301 outputs instructions to the sub-scanning motor driving circuit 304 to start the conveyance of the recording sheet 108*b*.

The processing shown in FIG. 10 has an advantage in addition to the advantage of the processing in FIG. 9. More specifically, after completion of image formation, if the sheet detection sensor 111 is located within the leading end detection range and if X<Y, the carriage 100 moves to a position for the sheet detection sensor 111 to be located at the detection position 200. In this manner, the chance of reducing the completion time of a job can be further increased than that in the case shown in FIG. 9.

Figure 11:
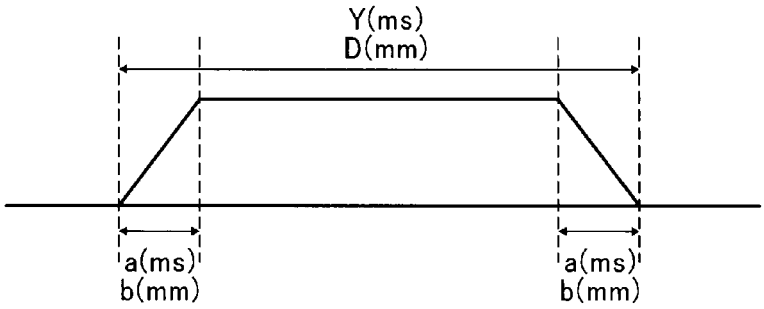
FIG. 11 is a diagram illustrating a movable distance of the carriage 100.

FIG. 11 is a diagram illustrating the movable distance of the carriage 100. The movable distance is the distance that the carriage 100 can move in time Y (after the start of the conveyance of a succeeding recording sheet 108*b* until the leading end of the recording sheet 108*b* reaches the detection position 200). If the carriage 100 starts moving and stops at the detection position 200 within time Y, the conveyance of the recording sheet 108*b* does not need to await.

In FIG. 11, time Y [ms] is the time required for the recording sheet 108*b* to move from its position after completion of image formation on a preceding recording sheet 108*a* to the detection position 200. The movable distance D [mm] in time Y [ms] is represented by the following equation (1):

$$D=2b+(Y-2a)S \quad (1).$$

Here, "a" is the acceleration-deceleration time [ms] of the main-scanning motor 105, b is the distance [mm] required for the acceleration-deceleration by the main-scanning motor 105, and S is the speed [mm/ms] of the carriage 100 during constant movement.

Figure 12:
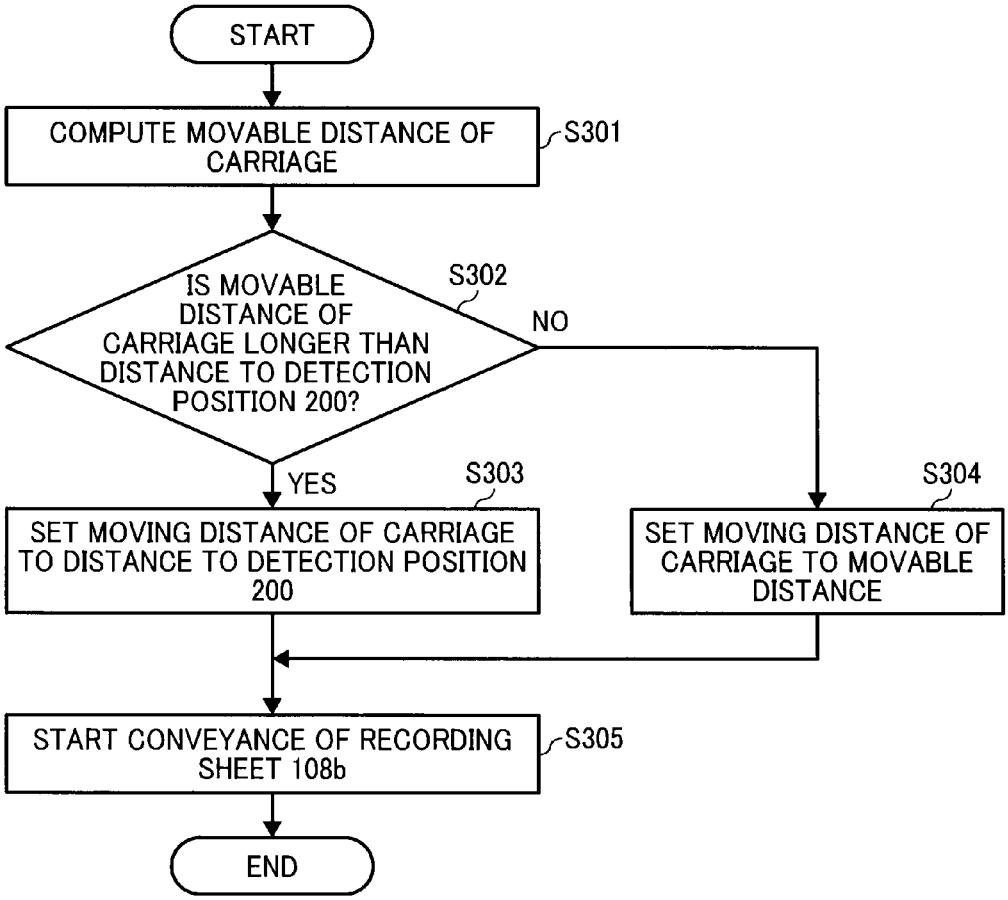
FIG. 12 is flowchart showing processing (3) for controlling the detection position.
Figure 13:
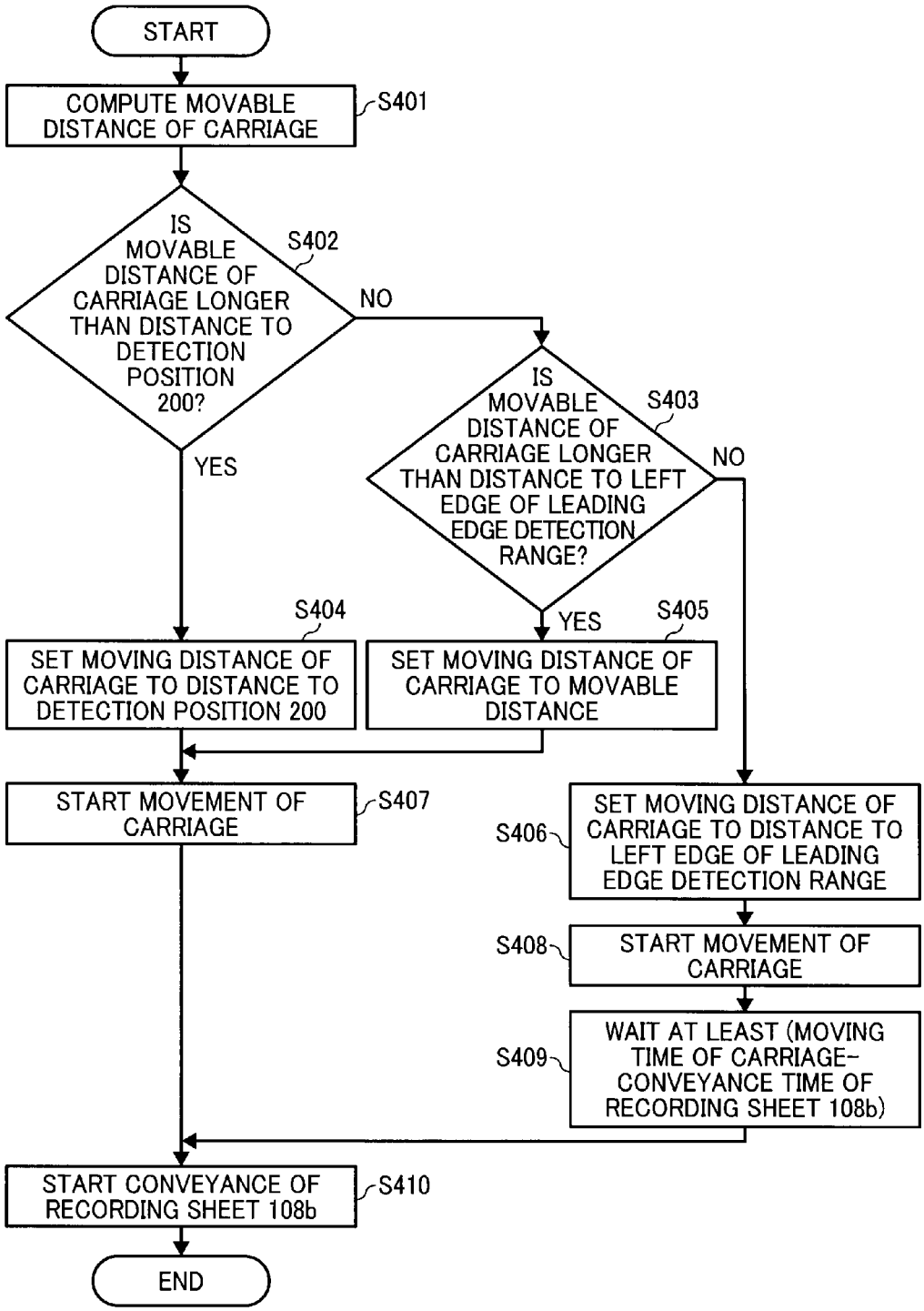
FIG. 13 is flowchart showing processing (4) for controlling the detection position.
Figure 14:
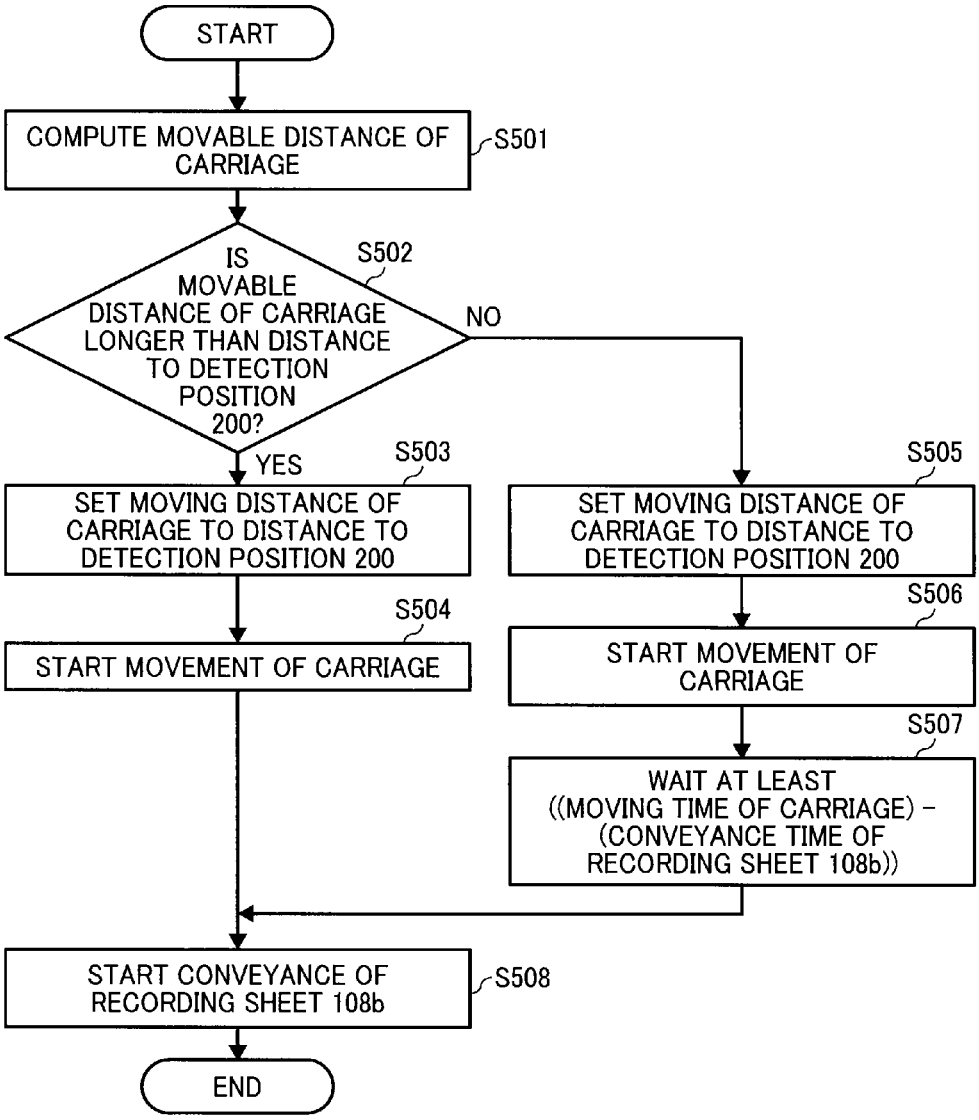
FIG. 14 is flowchart showing processing (5) for controlling the detection position.

FIGS. 12 to 14 are flowcharts showing processing for controlling the position of the leading end of the carriage 100, and the processing includes computation of the movable distance. In FIG. 12 to FIG. 14, the positions of the sheet detection sensor after completion of the final scan on a recording sheet 108*a* are different, respectively.

FIG. 12 is a flowchart showing an example in which the position of the sheet detection sensor 111 after completion of the final scan on a recording sheet 108*a* is within the leading end detection range.

In step S301 in FIG. 12, the main control unit 301 calculates the movable distance D of the carriage 100 using the equation (1). The current position of the carriage 100 is determined based on the input from the carriage position detection circuit 305.

The process proceeds from step S301 to step S302, and the main control unit 301 determines whether or not the movable distance D of the carriage 100 calculated in step S301 is longer than the distance from the current position of the carriage 100 to the detection position 200. The process proceeds to step S303 if the movable distance D is longer than the distance to the detection position 200. If not, the process proceeds to step S304.

In step S303 subsequent to step S302, the main control unit 301 sets the moving distance of the carriage 100 as the distance to the detection position 200 and then starts moving the carriage 100. More specifically, for example, the main control unit 301 outputs instructions including the information of the moving distance to the main-scanning motor driving circuit 303.

In step S304 subsequent to step S302, the main control unit 301 sets the moving distance of the carriage 100 as the movable distance and starts moving the carriage 100 in a direction toward the start position of image formation. More specifically, for example, the main control unit 301 outputs instructions including the information of the moving distance to the main-scanning motor driving circuit 303.

In step S305 subsequent to step S303 or S304, the main control unit 301 outputs instructions to the sub-scanning motor driving circuit 304 to start the conveyance of a recording sheet 108*b*.

In the processing in FIG. 12, the conveyance of the recording sheet 108*b* does not need to await, and the moving distance of the carriage 100 to the start position of image formation after the detection of the leading end of the recording sheet 108*b* can be reduced.

FIG. 13 is a flowchart showing an example in which the position of the sheet detection sensor 111 after completion of the final scan of a recording sheet 108*a* is on a side opposite to the start position of image formation with respect to the leading end detection range. In the present embodiment, the side opposite to the start position of image formation is the left side.

In step S401 in FIG. 13, the main control unit 301 calculates the movable distance D of the carriage 100 using the equation (1). The current position of the carriage 100 is determined based on the input from the carriage position detection circuit 305.

The process proceeds from step S401 to step S402, and the main control unit 301 determines whether or not the movable distance D of the carriage 100 calculated in step S401 is longer than the distance from the current position of the carriage 100 to the detection position 200. The process proceeds to step S404 if the movable distance D is longer than the distance from the current position of the carriage 100 to the detection position 200. If not, the process proceeds to step S403.

In step S403 subsequent to step S402, the main control unit 301 determines whether or not the movable distance of the carriage 100 is longer than the distance to the left edge of the leading end detection range. The process proceeds step S405 if the movable distance is longer. If not, the process proceeds to step S406.

In step S404 subsequent to step S402, the main control unit 301 sets the moving distance of the carriage 100 as the distance to the detection position 200.

In step S405 subsequent to step S403, the main control unit 301 sets the moving distance of the carriage 100 as the movable distance D. In step S406 subsequent to step S403, the moving distance of the carriage 100 is set to the distance to the left edge of the leading end detection range.

The process proceeds from step S404 or S405 to step S407, and the main control unit 301 outputs instructions to the main-scanning motor driving circuit 303 to start moving the carriage 100. These instructions may include the information of the moving distance of the carriage 100 determined in step S404 or S405.

In step S408 subsequent to step S406, the main control unit 301 outputs instructions to the main-scanning motor driving circuit 303 to start moving the carriage 100. These instructions may include the information of the moving distance of the carriage 100 determined in step S406.

The process proceeds from step S408 to step S409, and the main control unit 301 waits at least (the moving time of the carriage—the conveyance time required for a succeeding recording sheet 108*b* to reach the detection position 200).

The process precedes from step S407 or S409 to S410, and the main control unit 301 outputs instructions to the sub-scanning motor driving circuit 304 to start the conveyance of the recording sheet 108*b*.

In the processing in FIG. 13, the carriage 100 can be moved to the right as much as possible within the time required for the leading end of the recording sheet 108*b* to reach the detection position 200. When the carriage 100 cannot reach the leading end detection range within the time required for the leading end of the recording sheet 108*b* to reach the detection position 200, the consideration of the time required for the carriage 100 to reach the left edge of the leading end detection range is taken and the conveyance of the recording sheet 108*b* is started. In this manner, the moving amount of the carriage 100 until the leading end of the recording sheet 108*b* is detected can be minimized.

FIG. 14 is a flowchart showing an example in which the position of the sheet detection sensor 111 after completion of the final scan of a recording sheet 108*a* is on a side of the start position of image formation with respect to the leading end detection range. In the present embodiment, the image formation start position side is the right side.

In step S501 in FIG. 14, the main control unit 301 calculates the movable distance D of the carriage 100 using the equation (1). The current position of the carriage 100 is determined based on the input from the carriage position detection circuit 305.

The process proceeds from step S501 to step S502, and the main control unit 301 determines whether or not the movable distance D of the carriage 100 calculated in step S501 is longer than the distance from the current position of the carriage 100 to the detection position 200. The process proceeds to step S503 if the movable distance D is longer than the distance from the current position of the carriage 100 to the detection position 200. If not, the process proceeds to step S505.

In step S503 subsequent to step S502, the main control unit 301 sets the moving distance of the carriage 100 as the distance from the current position to the detection position 200. In step S504 subsequent to step S503, the main control unit 301 instructs the main-scanning motor driving circuit 303 to move the carriage 100. Preferably, these instructions include the information of the moving distance obtained in step S503.

In step S505 subsequent to step S502, the main control unit 301 sets the moving distance of the carriage 100 as the distance from the current position to the detection position 200. In step S506 subsequent to step S505, the main control unit 301 instructs the main-scanning motor driving circuit 303 to start moving the carriage 100. Preferably, these instructions include the information of the moving distance obtained in step S505.

The process proceeds from step S506 to step S507, and the main control unit 301 waits at least (the moving time of the carriage—the conveyance time required for a recording sheet 108*b* to reach the detection position 200).

The process precedes from step S504 or S507 to step S508, and the main control unit 301 outputs instructions to the sub-scanning motor driving circuit 304 to start the conveyance of the recording sheet 108*b*.

In the processing in FIG. 14, the leading end of the recording sheet 108*b* can be detected after the carriage 100 is moved to the right edge of the leading end detection range. Since the right edge of the leading end detection range is closest to the image formation start position than any other position in the leading end detection range, the time required for the job can be reduced.

Implementation Using Computers etc.

The image forming apparatus in the embodiment of the present invention may be implemented using, for example, a personal computer (PC). The image forming method in the embodiment of the present invention is executed by a CPU according to a program stored in a storage unit such as a ROM or a hard disk with a main memory such as a RAM used as a work area.

The preferred embodiment of the present invention has been described. However, the present invention is not limited to the preferred embodiment described above. Various modifications may be made within the scope of the invention.

According to an aspect of the present invention, in the image forming apparatus the position of an image formation in a job of forming images continuously on a plurality of mediums can be accurately determined, and thereby the time required for the job can be reduced.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus comprising:

a detection unit for scanning in a main-scanning direction at a speed equal to a speed of a carriage that moves in the main-scanning direction while discharging ink so as to detect a position of a leading end of a medium in a sub-scanning direction;

a position acquisition unit for acquiring an end position of the detection unit in the main-scanning direction when image formation on a first medium is completed; and a control unit for controlling a leading end detection position of the detection unit in the main-scanning direction according to a moving amount of the detection unit and a moving amount of the medium when a leading end of a second medium is detected by the detection unit on which an image is formed following to the first medium, the moving amount of the detection unit being an amount corresponding to time required for the movement of the detection unit from the end position to a predetermined position of the main-scanning direction, the moving amount of the medium being an amount corresponding to a moving time of the medium required for the leading end of the second medium to move to a predetermined position in the sub-scanning direction.

2. The image forming apparatus according to claim 1, wherein the predetermined position in the main scanning direction is included in a leading end detection range, which is a minimum width range on a medium in the main-scanning direction, or a predetermined range included within the minimum width range, the minimum width range being a width within which the image forming apparatus forms an image.

3. The image forming apparatus according to claim 2, wherein the control unit sets the end position as the leading end detection position when the end position is included in the leading end detection range.

4. The image forming apparatus according to claim 2, wherein the control unit sets the end position as the leading position detection position when the end position is included in the leading end detection range and the moving amount of the detection unit is equal to or greater than the moving amount of the medium.

5. The image forming apparatus according to claim 2, wherein the control unit sets a position as the leading position detection position, which is included in the leading end detection range and included in a range of distance in which the detection unit is movable from the end position within the moving time of the medium.

6. The image forming apparatus according to claim 5, wherein the control unit sets a position as the leading end detection position, which is included in the leading end detection range and closest to a start position of image formation on the second medium than any other position in the range of distance in which the detection unit is movable from the end position within the moving time of the medium.

7. An image forming method comprising steps of:

scanning in a main-scanning direction at a speed equal to a speed of a carriage that moves in the main-scanning direction while discharging ink so as to detect a position of a leading end of a medium in a sub-scanning direction;

acquiring an end position of a detection unit in the main-scanning direction when image formation on a first medium is completed; and controlling a leading end detection position of the detection unit in the main-scanning direction when a leading end of a second medium is detected by the detection unit on which an image is formed following to the first medium, the controlling is performed according to a moving amount of the detection unit and a moving amount of the medium, the moving amount of the detection unit being an amount corresponding to time required for the movement of the detection unit from the end position to a predetermined position of the main-scanning direction, the moving amount of the medium being an amount corresponding to a moving time of the medium required for the leading end of the second medium to move to a predetermined position in the sub-scanning direction.

8. The image forming method according to claim 7, wherein the predetermined position in the main scanning direction is included in a leading end detection range, which is a minimum width range on a medium in the main-scanning direction, or a predetermined range included within the minimum width range, the minimum width range being a width within which an image forming apparatus forms an image.

9. The image forming method according to claim 8, wherein the controlling includes setting the end position as the leading end detection position when the end position is included in the leading end detection range.

10. The image forming method according to claim 8, wherein the controlling includes setting the end position as the leading position detection position when the end position is included in the leading end detection range and the moving amount of the detection unit is equal to or greater than the moving amount of the medium.

11. The image forming method according to claim 8, wherein the controlling includes setting a position as the leading end detection position, which is included in the leading end detection range and included in a range of distance in which the detection unit is movable from the end position within the moving time of the medium.

12. The image forming method according to claim 11, wherein the controlling includes setting a position as the leading end detection position, which is included in the leading end detection range and closest to a start position of image formation on the second medium than any other position in the range of distance in which the detection unit is movable from the end position within the moving time of the medium.

13. A non-transitory computer readable storage medium embedding a program configured to execute by a computer steps of:

scanning in a main-scanning direction at a speed equal to a speed of a carriage that moves in the main-scanning direction while discharging ink so as to detect a position of a leading end of a medium in a sub-scanning direction;

acquiring an end position of a detection unit in the main-scanning direction when image formation on a first medium is completed; and controlling a leading end detection position of the detection unit in the main-scanning direction when a leading end of a second medium is detected by the detection unit on which an image is formed following to the first medium, the controlling is performed according to a moving amount of the detection unit and a moving amount of the medium, the moving amount of the detection unit being an amount corresponding to time required for the movement of the detection unit from the end position to a predetermined position of the main-scanning direction, the moving amount of the medium being an amount corresponding to a moving time of the medium required for the leading end of the second medium to move to the predetermined position in a sub-scanning direction.

14. The non-transitory computer readable storage medium according to claim 13, wherein the predetermined position is included in a leading end detection range, which is a minimum width range on a medium in the main-scanning direction, or a predetermined range included within the minimum width range, the minimum width range being a width within which an image forming apparatus forms an image.

15. The non-transitory computer readable storage medium according to claim 14, wherein the controlling includes setting the end position as the leading end detection position when the end position is included in the leading end detection range.

16. The non-transitory computer readable storage medium according to claim 14, wherein the controlling includes setting the end position as the leading position detection position when the end position is included in the leading end detection range and the moving amount of the detection unit is equal to or greater than the moving amount of the medium.

17. The non-transitory computer readable storage medium according to claim 14, wherein the controlling includes setting a position as the leading end detection position, which is included in the leading end detection range and included in a range of distance in which the detection unit is movable from the end position within the moving time of the medium.

18. The non-transitory computer readable storage medium according to claim 17, wherein the controlling includes setting a position as the leading end detection position, which is included in the leading end detection range and closest to a start position of image formation on the second medium than any other position in the range of distance in which the detection unit is movable from the end position within the moving time of the medium.

* * * * *